US008375842B2

(12) United States Patent
Kolbenschlag et al.

(10) Patent No.: US 8,375,842 B2
(45) Date of Patent: Feb. 19, 2013

(54) ELECTRO-PNEUMATIC SYSTEM FOR CONTROLLING A DOUBLE-ACTING PNEUMATIC ACTUATOR

(75) Inventors: Stefan Kolbenschlag, Darmstadt (DE); Dirk Klee, Niederdorfelden (DE)

(73) Assignee: Samson Aktiengesellschaft, Frankfurt (DE)

( * ) Notice: Subject to any disclaimer, the term of this patent is extended or adjusted under 35 U.S.C. 154(b) by 786 days.

(21) Appl. No.: 12/582,953

(22) Filed: Oct. 21, 2009

(65) Prior Publication Data

US 2010/0132542 A1 Jun. 3, 2010

(30) Foreign Application Priority Data

Oct. 30, 2008 (DE) ..... 10 2008 053 844

(51) Int. Cl.
*F15B 21/08* (2006.01)
*F15B 15/22* (2006.01)

(52) U.S. Cl. ..... 91/361; 91/459

(58) Field of Classification Search ..... 91/361, 91/459

See application file for complete search history.

(56) References Cited

U.S. PATENT DOCUMENTS

| | | | | |
|---|---|---|---|---|
| 4,481,451 | A * | 11/1984 | Kautz et al. | 91/361 |
| 5,431,086 | A * | 7/1995 | Morita et al. | 91/361 |
| 6,705,199 | B2 * | 3/2004 | Liao et al. | 91/363 R |
| 7,021,191 | B2 * | 4/2006 | Moler et al. | 91/393 |
| 7,421,938 | B2 * | 9/2008 | Kah | 91/361 |
| 2007/0186974 | A1 * | 8/2007 | Kolbenschlag | 137/82 |

FOREIGN PATENT DOCUMENTS

| | | | |
|---|---|---|---|
| DE | 100 21 744 | A1 | 11/2001 |
| DE | 202004002504 | U1 * | 8/2004 |

* cited by examiner

*Primary Examiner* — Thomas E Lazo
(74) *Attorney, Agent, or Firm* — Schiff Hardin LLP

(57) ABSTRACT

In an electro-pneumatic system for controlling a double-acting pneumatic actuator having first and second working chambers, first and second preliminary pneumatic control components generate first and second preliminary pneumatic control signals transferred to respective first and second main pneumatic control components having outputs connected to the respective first and second working chambers. An electronic splitter circuit precedes the first and second preliminary pneumatic control components for splitting and inverting an electrical control signal input to the splitter circuit around an electrical mean control value to create first and second mirror-inverted electrical control signals respectively connected to the respective first and second preliminary pneumatic control components. The electrical mean control value is adjustable such that the first and second preliminary control components respectively generate the respective first and second preliminary pneumatic control signals mutually inverted around a pneumatic mean value.

15 Claims, 5 Drawing Sheets

ELECTRO-PNEUMATIC SYSTEM FOR CONTROLLING A DOUBLE-ACTING PNEUMATIC ACTUATOR

BACKGROUND

The preferred embodiments relate to an electro-pneumatic system for controlling a double-acting pneumatic actuator having a first pneumatic working chamber and a second pneumatic working chamber controllable independently from the first working chamber.

Commonly an electro-pneumatic system comprises a preliminary pneumatic control component, especially an I/P-converter, for generating a preliminary pneumatic control signal, whereby the preliminary control signal is fed to a main pneumatic control component such as an air pressure amplifier connected to an air pressure supply of, for example, 6 bar. In this exemplary case the air pressure amplifier can generate a maximum pressure of 6 bar.

Double-acting pneumatic actuators have multiple applications in the technical processing industry, especially in power generation technology. For example, typical applications of double-acting pneumatic actuators are directed towards demanding control tasks in which, for example, a valve cap in a pipeline filled with fluid must be positioned rapidly and precisely. A double-acting pneumatic actuator does not require internal springs to drive a positioning member of the actuator into a certain emergency position when the pneumatic actuator is vented. The double-acting pneumatic drive can have a positioning piston separating two pneumatic working chambers, being coupled to the valve flap and being displaced when the pressure difference between the two working chambers reaches a predefined value. Double-acting actuators have the general advantage to be particularly robust and durable while having a structure that is of simple design and cost effective.

Commonly, the double-acting pneumatic actuator is controlled by an electro-pneumatic positioner generating an electrical control signal based on an electrical actual position value, such as the position of the control valve in the technical processing plant and an electrical set point signal from a superordinate control unit, and transforms the control signal by means of an I/P-converter into a preliminary pneumatic control signal. The preliminary pneumatic control signal is then fed to an inverting amplifier which transmits opposing main pneumatic signals to the working chambers of the double-acting actuator. The pneumatic working chambers of the double-acting pneumatic actuator are pressurized against each other by a constant mean pressure value.

DE 10021 744 A1 gives an example of a double-acting pneumatic actuator in which a pressure difference between the two working chambers of the actuator is defined as the control variable. For adjusting the pressure difference the pneumatic inverting amplifier receives the control pressure generated by the I/P-converter on the basis of which the desired pressure difference is generated in the working chambers of the double-acting pneumatic actuator. The first output of the inverting amplifier receives the control pressure of the I/P-converter, wherein at the second output a respective opposite pressure is built up, complementing the control pressure at the first output to the constant supply pressure of, for example, 6 bar.

The functional necessity for the inverting amplifier results from the fact that a decrease of the first control pressure in the first working chamber requires an increase of the second control pressure in the second working chamber, wherein the main pressure value remains unchanged.

Commonly, a double-acting pneumatic actuator works by means of a supply pressure of about 6 bar, wherein a constant mean pressure value of 3.5 bar is defined between the first and the second working chamber. The double-acting pneumatic actuator can realize fast control cycles but has the disadvantage not to be sufficiently rigid because of the compressibility of the working medium air at 3.5 bar. If the application of the actuator requires a higher rigidity, hydraulic actuators are commonly used which are expensive and not suitable for all applications, especially due to the threat they pose to the environment by the hydraulic oil.

SUMMARY

It is an object to provide a positioner for controlling a double-acting pneumatic actuator substantially universally applicable also in situations where fast control cycles are to be combined with a high and especially adjustable rigidity of the actuator.

In an electro-pneumatic system for controlling a double-acting pneumatic actuator having first and second working chambers, first and second preliminary pneumatic control components generate first and second preliminary pneumatic control signals transferred to respective first and second main pneumatic control components having outputs connected to the respective first and second working chambers. An electronic splitter circuit precedes the first and second preliminary pneumatic control components for splitting and inverting an electrical control signal input to the splitter circuit around an electrical mean control value to create first and second mirror-inverted electrical control signals respectively connected to the respective first and second preliminary pneumatic control components. The electrical mean control value is adjustable such that the first and second preliminary control components respectively generate the respective first and second preliminary pneumatic control signals mutually inverted around a pneumatic mean value.

Advantages, characteristics and features will become apparent through the following description of preferred embodiments of the invention in conjunction with the following drawings.

BRIEF DESCRIPTION OF THE DRAWINGS

FIG. 3 is a schematic diagram of a field device according to the preferred embodiment with a double-acting actuator according to the;

DESCRIPTION OF THE PREFERRED EMBODIMENTS

Figure 1:
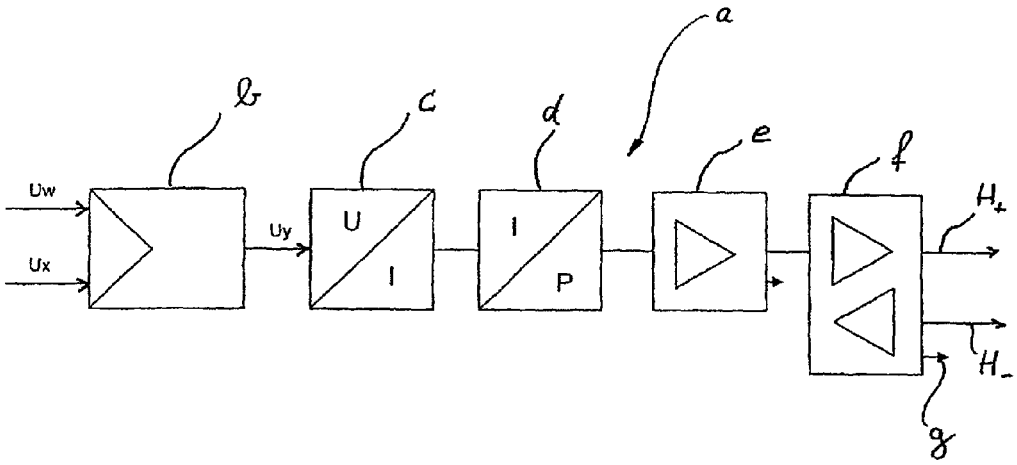
Fig. 1 Prior art
FIG. 1 is a schematic diagram of an electro-pneumatic system for controlling a double-acting pneumatic actuator according to the prior art.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated devices and such further applications of the principles of the invention as illustrated as would normally occur to one skilled in the art to which the invention relates are included.

The electro-pneumatic system of the preferred embodiment has been improved in that an electronic splitter circuit precedes the preliminary pneumatic control component in order to split and invert the electrical control signal received by the electro-pneumatic system or generated by a control circuitry of the electro-pneumatic system, generating two mirror-inverted electrical signals around an electrical mean control value. According to the preferred embodiment, the electronic splitter circuit is designed to adjust the mean control value, wherein the preliminary control component generates two inverted preliminary control signals around a pneumatic mean value based on the electrical control mean value and the mirror-inverted signals. The preliminary pneumatic control signals are fed to a main control component to generate the adjusted mean pressure value and the respective pressure difference in the respective working chambers of the double-acting actuator.

The preferred embodiment technique of preceding the preliminary pneumatic control component by an electronic splitter circuit makes a pneumatic inverting amplifier redundant. In this way, the electro-pneumatic system becomes cheaper and simpler in its structure. In particular the fixed referencing of the output pressures to an unchangeable mean pressure value is overcome because, according to the preferred embodiment, the generation of the pressure difference by means of inverted signals is shifted away from the pneumatic side towards the electronic side of the control system. According to the preferred embodiment, the mean pressure value between the pneumatic output signals can be continuously adapted between atmospheric pressure and the maximum supply pressure (for example 6 bar). In this way, for example, a positioner can be provided for a double-acting pneumatic actuator that is working resiliently for fast control cycles and rigidly in certain operating conditions.

In a preferred embodiment the preliminary pneumatic control component has two independently controllable I/P-converters one of which receives a first electric mirror-inverted signal from the electronic splitter circuit, while the other I/P-converter receives the second electric mirror-inverted signal, which has the opposite direction compared to the first electric mirror-inverted signal with respect to an adjustable mean value.

It is to be understood that the mirror-inverted signals of the electronic splitter circuit can also be adjusted in such a way that both working chambers can receive the maximum supply pressure of the respective main control component in order to maintain the double-acting pneumatic actuator as rigid as possible. However, the sum of the pressures. i.e. the mean pressure value of the pressures present in both working chambers can be distinctively lower than 3 bar, for example 1 or 2 bar, in order to realize fast changing control cycles.

In a preferred embodiment the electronic splitter circuit has a voltage divider receiving the control signal and generating two inverted control voltage signals adjusted around a variable mean voltage value. The voltage divider can be connected to two voltage/current converters, one of which receives the first control voltage signal while the other voltage/current converter receives the second control voltage signal, inverted with respect to the first one.

In a further development of the preferred embodiment, one output channel of the respective voltage/current converter is respectively connected to one I/P converter.

In a further development of the preferred embodiment the electro-pneumatic system is designed as a positioner and has a micro processor for receiving a position set point value and an actual position value from a position sensor, on the basis of which the electrical control signal is generated.

In a preferred embodiment a device for adjusting the mean control value is connected to the electronic splitter circuit. Preferably the adjustment device can comprise an actuating button or switch operable from the outside of the system. For example, the adjustment device can receive an adjustment value via a communication unit such as HART, BUS, Funk, Bluetooth, Zigbie-Wlan, or the like.

Furthermore, the preferred embodiment relates to an arrangement with an electro-pneumatic system as well as with a main control component succeeding the preliminary pneumatic control component and formed by two independently controllable pneumatic amplifiers. Each of the pneumatic amplifiers is connected to a pressure supply of for example 6 bar.

Preferably a pneumatic amplifier is connected with the output of an I/P-converter of the preliminary pneumatic control component whereas the other pneumatic amplifier is connected with the output of the other I/P-converter of the preliminary pneumatic control component.

In a further development of the preferred embodiment a first I/P-converter of the preliminary pneumatic control component and a pneumatic amplifier connected thereto are contained in an enclosed, in particular intrinsically safe, housing, while the second I/P-converter of the preliminary pneumatic control component and the pneumatic amplifier connected thereto is accommodated in a second enclosed, in particular intrinsically safe housing, separated from the first housing and in particular fixed thereto.

Preferably the preliminary pneumatic control component and the main pneumatic control component are accommodated in a common housing.

Furthermore, the preferred embodiment relates to a method for extending or upgrading an existing electro-pneumatic system for controlling a double-acting pneumatic actuator having a first pneumatic working chamber and second working chamber independent therefrom, wherein the electro-pneumatic system comprises an I/P-converter and a pneumatic amplifier connected thereto. According to the preferred embodiment, a second I/P-converter as well as a second pneumatic amplifier, connected with the second I/P-converter is provided. Two electrical control signals are generated, inverted around a variable mean value, and fed respectively to each of the I/P-converters in order to create inverted preliminary pneumatic signals to be fed to the respective pneumatic amplifier.

Through the electro-pneumatic system of the preferred embodiment, the arrangement and the upgrade method according to the preferred embodiment, the double-acting, pneumatic actuator can be adjusted not only with respect to the variable air pressure difference in the working chambers, resulting from the inverted pressures in the two working chambers, but also with respect to the mean pressure value of the two working chambers, in order to adjust the rigidity of the double-acting pneumatic actuator. The mean working chamber pressure value is already defined at the electronic level of the electro-pneumatic system by defining also the mean control value besides the two inverted control signals. This means that for pneumatic master amplifiers connected to a supply pressure of 6 bar the mean pressure value can be adjusted from atmospheric pressure up to 6 bar. Evidently, the largest pressure difference in the working chambers can be achieved when the mean pressure value is about 3.5 bar. For a mean pressure value of 4 bar a maximum pressure difference of 4 bar is available. For a mean pressure value of 5 bar a maximum pressure difference of 2 bar is available.

The pressure difference results in the relative displacement of the positioning piston of the double-acting pneumatic actuator, while the adjusted mean pressure value determines the rigidity of the double-acting pneumatic actuator.

Generally a common positioner for a double-acting pneumatic actuator comprises a known electro-pneumatic system a as it is shown for example in FIG. 1. The electro-pneumatic system has an electronic controller b that receives and processes an electric position set point value $U_W$ of a superordinate process control unit of the processing plant (not shown) and an electronic actual position value $U_X$ from a position sensor (not shown) which captures the position of a process valve member to be positioned.

The electronic controller b calculates an electrical control signal $U_y$ and passes it via its output to the input of a U/I-converter c which generates a corresponding electrical control current signal and passes it on to an I/P-converter d. On the basis of the current control signal the I/P-converter generates a preliminary pneumatic control signal that is passed on to a main control component in form of an air power amplifier e which is connected to an air pressure supply (not shown) of 6 bar.

The pneumatic inverting amplifier f connected to the air power amplifier e is used to generate two mutually opposing pneumatic main control signals H+, H− having a main pressure value of about 3.5 bar which are then fed to the respective working chamber of the double-acting pneumatic actuator. The venting of the pneumatic drive proceeds via the venting connection g. The mean pressure of the inverting amplifier f cannot be adjusted so that the double-acting pneumatic actuator has a non-changeable rigidity. The mechanics of the inverting amplifier f permit only a very imprecise adjustment of the main pneumatic signals, which is the reason why readjustments of the positioning pistons of the double-acting actuator are necessary.

Figure 2:
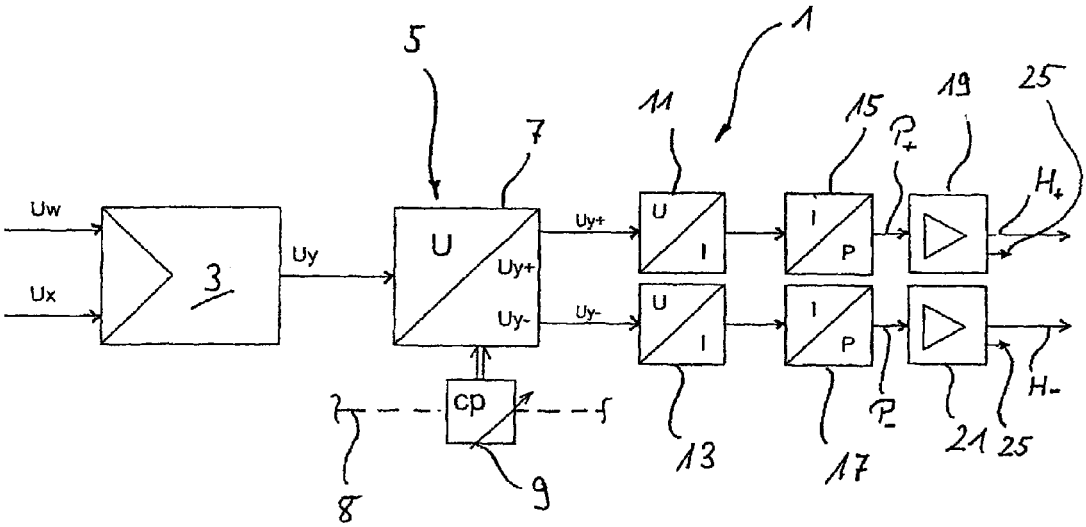
FIG. 2 is a schematic diagram of an electro-pneumatic system according to the preferred embodiment.

In the embodiment as in FIG. 2 the electro-pneumatic system according to the embodiment is generally given the reference numeral 1 and is designed as a positioner. The electro-pneumatic system 1 comprises an electronic controller 3 receiving a position set point value $U_W$ from a plant control unit (not shown) and an actual position value $U_X$ from a position sensor (not shown). The electronic controller 3 calculates an electric control signal $U_y$, which is fed to an electronic splitter circuit 5 according to the preferred embodiment. The electronic splitter circuit 5 comprises a voltage divider 7 dividing the electric control voltage signal $U_y$ in a first control voltage signal $U_{y+}$ and in a second control voltage signal $U_{y-}$. The voltage signals $U_{y+}$, $U_{y-}$ are inverted around an electrical mean control value cp, the inversion finally leading to the desired pressure difference in the working chambers of the double-acting pneumatic actuator, which pressure difference corresponds to a defined displacement of the positioning piston of the double-acting pneumatic actuator. The mean control value generated by the electronic splitter circuit 5 is variable and corresponds to the mean pressure value around which the control pressures vary inversely. Each generated mean value corresponds to a defined pressure control mean value.

The voltage divider 7 is connected with a working pressure mean value adjustment device 9 operable from the outside 8 of the electro-pneumatic system 1, for example in the form of a rotary switch, via which the electric mean control value cp is adjustable, around which the inverted voltage control signal $U_{y+}$, $U_{y-}$ are variable.

The first control voltage signal $U_{y+}$ as well as the second control voltage signal $U_{y-}$ are fed to a first U/I-converter 11 and to a second WI-converter 13 respectively, that generates a first and a second control current signal from the electric control voltage signals $U_{y+}$, $U_{y-}$, the control current signals being fed to the input of a first I/P-converter 15, respectively to a second I/P-converter 17. Mutually opposite preliminary pneumatic signals namely a first preliminary control signal $P_+$ and a second preliminary control signal P_ are output from the first and the second I/P-converters respectively. The first and the second preliminary pneumatic control signal $P_+$, P_ have the desired invertedness around an adjusted preliminary pneumatic mean value.

The preliminary pneumatic control signals $P_+$, P_ are independent pressure signals with an absolute signal strength. The preliminary pneumatic control mean value results from the mean value of the absolute preliminary pneumatic control signals $P_+$, P_. The two preliminary pneumatic control signals $P_+$, P_ are fed to a first air power amplifier 19 and to a second air power amplifier 21 respectively. Both air power amplifiers 19, 21 are connected to their own pressure supply 23, 25 of 6 bar. The main pneumatic control signals $H_+$, H− are fed to the respective working chambers of the pneumatically acting actuator.

With the electro-pneumatic system 1 of the preferred embodiment an inverting amplifier f is redundant. Furthermore, the main pneumatic control mean value can be easily adjusted in order to continuously adjust at will the rigidity of the double-acting actuator.

Figure 3:
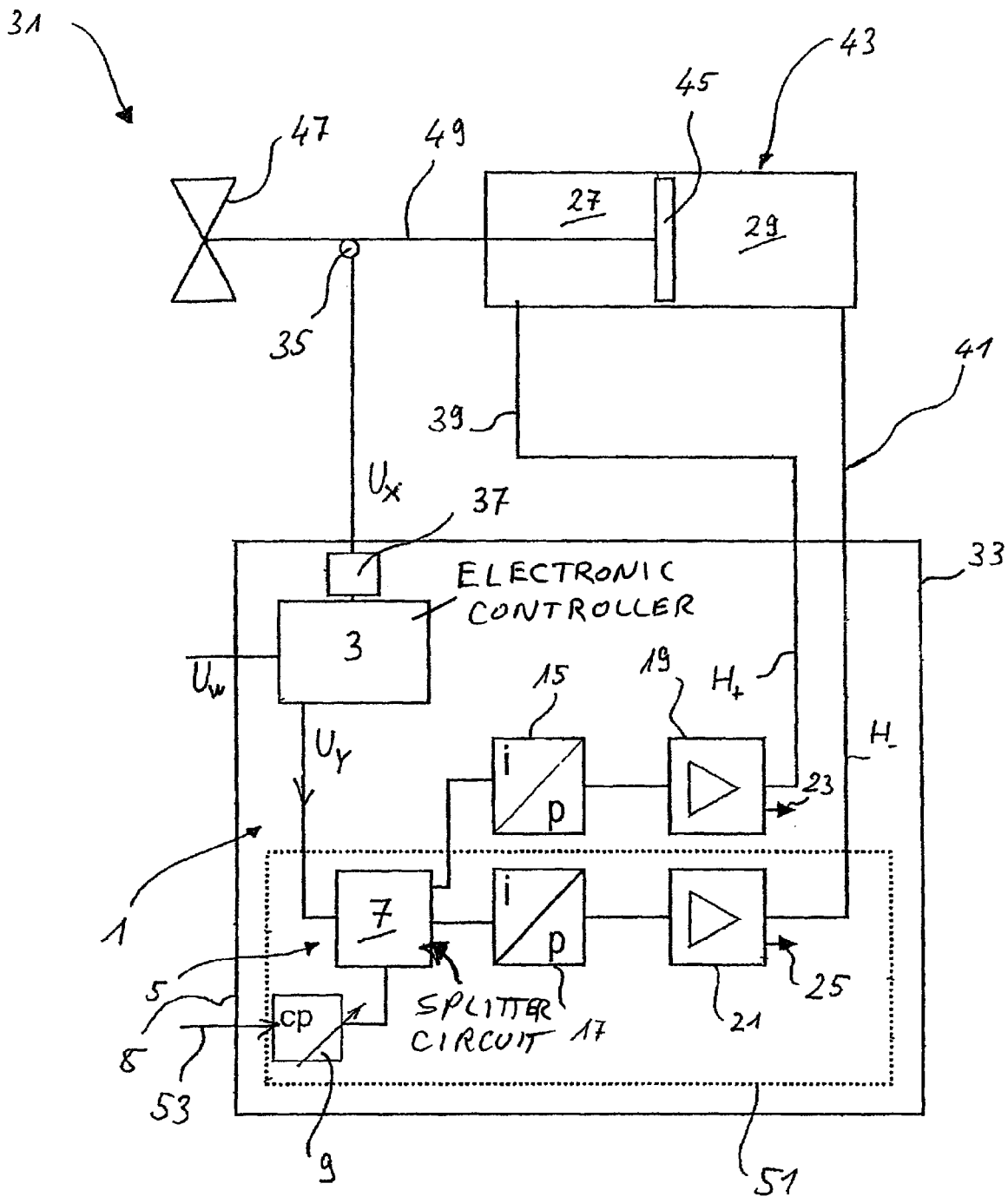

FIG. 3 shows a field device 31 according to the preferred embodiment with a pneumatic system 1 according to the preferred embodiment designed as a positioner both being accommodated in a common intrinsically safe housing 33. For good readability of the figure description the same reference numerals are used for the same components of the electro-pneumatic system in FIG. 2 and in FIG. 3.

The electronic controller 3 receives an electrical position set point value $U_W$ from a superordinate control unit (not shown) of a processing plant. The electric actual position value $U_X$ is fed by a position sensor 35 to the input 37 of the electronic controller 3 via the housing 33 of the positioner.

The inverted pneumatic main control signals $H_+$, H− of the main control component are transferred to a first working chamber 27, respectively to a second working chamber 29 of a double-acting pneumatic actuator 43 via pneumatic lines 39, 41. The double-acting pneumatic actuator 43 has a displaceable separating piston 45 separating the first working chamber 27 from the second working chamber 29 so that the working chambers 27, 29 can be pneumatically controlled independently from each other.

The separating piston 45 is connected with an adjustable valve 47 of the technical processing plant via a positioning rod 49, the position of which is captured by the position sensor 35. The adjustable valve 47 is used to control the stream of fluid within a fluid duct of the technical processing plant.

As is evident from FIG. 3, the electronic splitter circuit 5, the second I/P-converter, the second air power amplifier 21, as well as an electronic component of the mean working pressure adjustment device 9 can be arranged within a separate internal housing 51 which is accommodated inside the positioner housing 33. The adjustment device 9 is operable from the outside, which is indicated by arrow 53. In this way the functionality of an electro-pneumatic system 1 according to the embodiment can also be transferred to an already existing electro-pneumatic system, by building in system components in the additional internal housing 51 into the positioner housing 33 and connecting those to the controller. Furthermore, the internal housing 51 has two outputs, one electrical output for the first I/P-converter and a pneumatic output for connection of the second pneumatic line 41.

Figure 4:
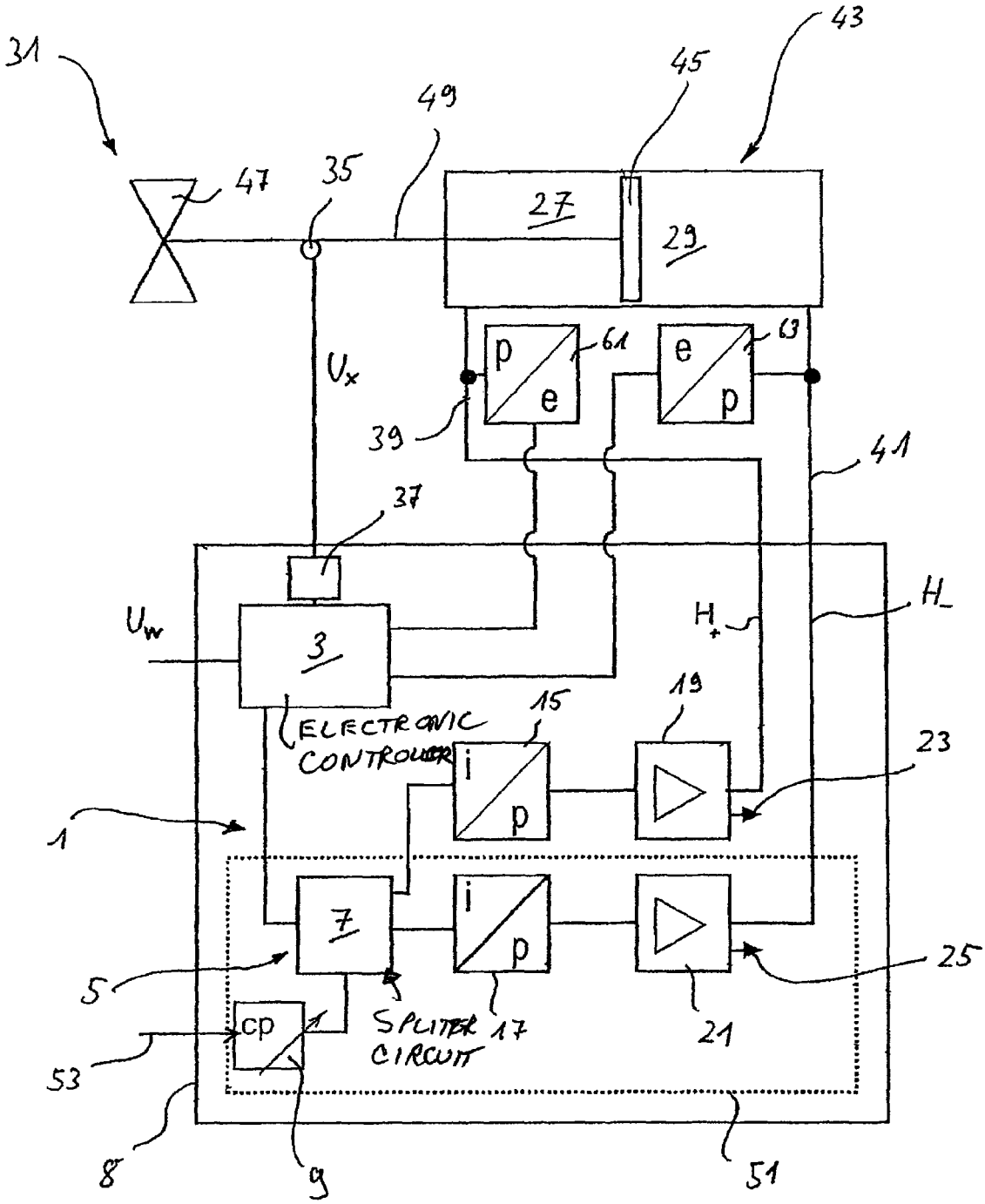
FIG. 4 is a schematic diagram of a field device in a further embodiment with a double-acting pneumatic actuator.

An embodiment of a field device according to FIG. 4 is distinguished from the one according to FIG. 3 in that pressure sensors 61, 63 are connected to the pneumatic lines 39, 41 for capturing the main control signals $H_+$, H−. The captured electric pressure signals $H_+$, H− are fed to the electronic controller 3 in order to readjust if necessary the main control signals $H_+$, H− as well as their absolute value with respect to the working mean pressure value cp as a function of the actual position value $U_X$.

Figure 5:
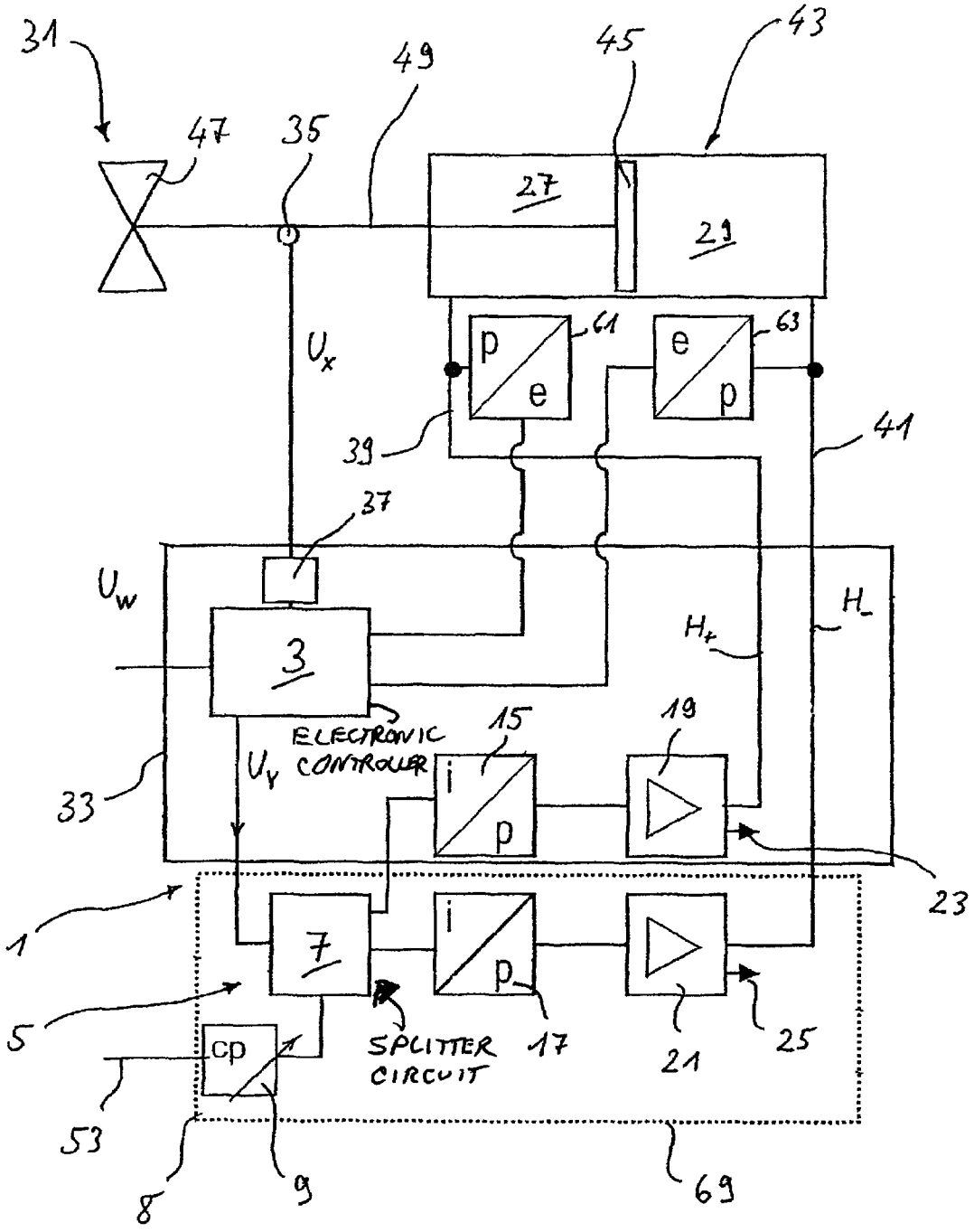
FIG. 5 is a schematic diagram of a field device in a further embodiment with a double-acting pneumatic actuator.

The embodiment of a field device according to FIG. 5 is distinguished from the embodiment according to FIG. 4 in that the positioner housing 33 is separated from an additional external housing 69 for the electronic splitter circuit 5, an electronic component of the adjustment device 9, the second I/P-converter, and the second air power amplifier 21. The additional outer housing 69 has an input for receiving the electrical control signal $U_y$, an output for transmitting the first control current signal to the first I/P-converter 15 and a pneumatic output for transferring the second main control signal H− to the second working chamber 29 of the double-acting pneumatic actuator 43, and it is flanged to the positioner housing 33. The positioner housing 33 has respective output/input connections positioned mirror symmetrically to the input/output of the outer housing 69.

In the diagrams 6*a* to 6*c* are indicated the different pressures exertable in the working chambers 27, 29 of the double-acting pneumatic actuator 43, wherein in the diagrams 6*a* to 6*c* respectively a different mean working pressure value cp as well as the possible courses of the absolute control voltage signals $U_{y+}$ and $U_{y-}$ are represented, which lead to the main control mean values $H_+$, H−.

Figure 6A:
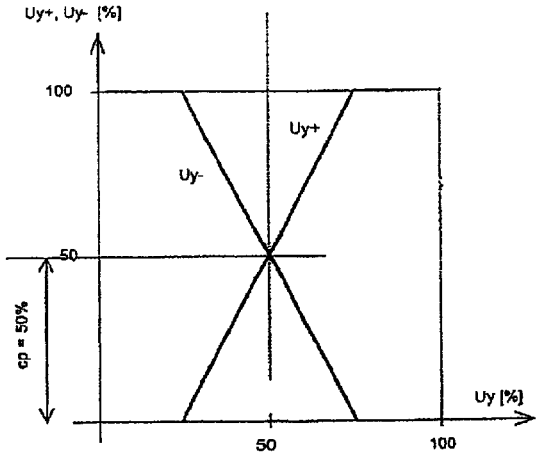
FIGS. 6*a* to 6*c* are diagrams showing the path of the electrical control voltage signals $U_{y+}$, and $U_{y-}$ and their variable mean values cp (16%, 76%, 50%).

In FIG. 6*a* the working pressure mean value cp is adjusted at 50%, i.e. 50% (3.5 bar) of a maximum pressure of 6 bar is determined as the mean pressure value of the working pressure in the working chambers. In order to move the separating piston 45 of the double-acting actuator, a pressure difference based on the working pressure mean value cp must be generated by generating inverted control signals $U_{y+}$ and $U_{y-}$. Therein the entire range of 0 to 100% can be utilized for the control signals. For example for the first control signal $U_{y+}$ 100% signal value (i.e. 6 bar) can be adjusted whereby, because of the invertedness, the control signal $U_{y-}$ can be at 0%, that is atmospheric pressure. In this case a maximum displacement of the separating piston 45 can be achieved.

Figure 6B:
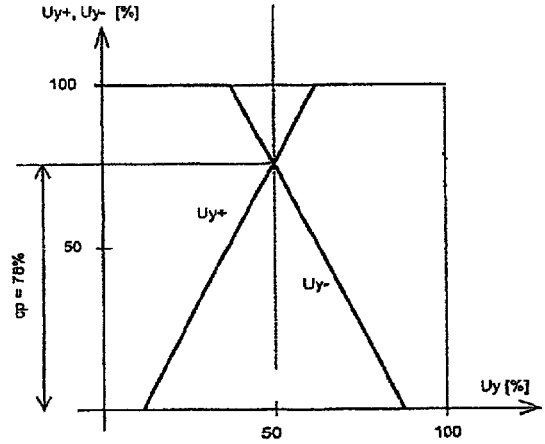

If however the working pressure mean value cp is adjusted to 76%, as represented in FIG. 6*b*, the working pressure mean value of about 4.6 bar will be present. In this way the rigidity of the double-acting pneumatic actuator is increased with respect to the operating state shown in FIG. 6*a*. With a working pressure mean value of cp=76% the maximum pressure difference between the working chambers is limited to 48% (2×24%). If for the first control signal $U_{y+}$ a 6 bar pressure value is adjusted, the inverted control signal value $U_{y-}$ is respectively determined to 52% (76%−24%).

Figure 6C:
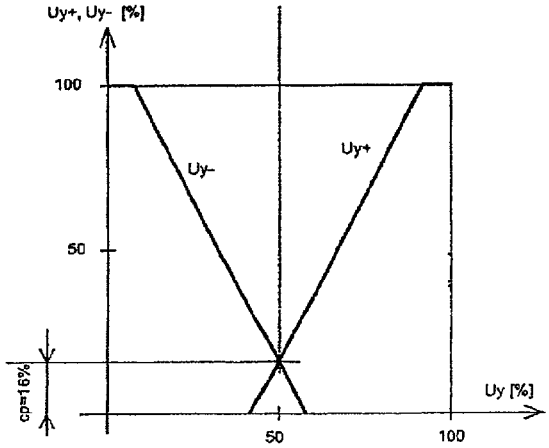

In FIG. 6*c* an operating situation with a reduced pressure mean value cp of 16% is represented. In this way the double-acting pneumatic actuator is made resilient. The actual working pressure mean value is at 2 bar wherein a maximum pressure difference of 32%, i.e. 3 bar, is permitted in the working chambers 27, 29. Here the working pressure in the first working chamber could be adjusted to 2 bar maximum while the pressure in the second working chamber is 1.0 bar.

By changing the working pressure mean value cp from 50% in order to increase or reduce the rigidity, the maximum adjustable pressure difference in the working chambers 27, 29 is accordingly reduced.

The features described can be relevant in individually as well as in any combination for realizing the invention in its many different potential embodiments.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. An electro-pneumatic system for controlling a double-acting pneumatic actuator having a first pneumatic working chamber and a second pneumatic working chamber controllable independently from the first working chamber, comprising:

first and second preliminary pneumatic control components for generating first and second preliminary pneumatic control signals transferred to respective first and second main pneumatic control components having respective pneumatic outputs for connection to said respective first and second working chambers; and an electronic splitter circuit preceding said first and second preliminary pneumatic control components for splitting and inverting an electrical control signal input to said splitter circuit around an electrical mean control value to create first and second mirror-inverted electrical control signals respectively connected to said respective first and second preliminary pneumatic control components, and the electrical mean control value being adjustable such that said first and second preliminary control components respectively generate said respective first and second preliminary pneumatic control signals mutually inverted around a pneumatic mean value.

2. The electro-pneumatic system according to claim 1 wherein said first and second preliminary pneumatic control components comprise respective first and second I/P converters independently controllable from each other, the first I/P converter receiving the first mirror-inverted electrical control signal and the second I/P converter receiving the second mirror-inverted electrical control signal.

3. The electro-pneumatic system according to claim 1 wherein the electronic splitter circuit comprises a voltage divider receiving said electrical control signal input to said splitter circuit and generating said first and second mirror/inverted electrical control signals mutually inverted around said adjustable electrical mean control value which is a voltage value.

4. The electro-pneumatic system according to claim 3 wherein said voltage divider is connected to first and second voltage/current converters, the first converter receiving said first mirror/inverted electrical control signal and the second voltage/current converter receiving said second mirror/inverted electrical control signal.

5. The electro-pneumatic system according to claim 4 wherein an output of said first voltage/current converter is connected to said first I/P converter and an output of said second voltage/current converter is connected to said second I/P converter.

6. The electro-pneumatic system according to claim 1 wherein said system functions as a positioner and further comprises a micro-processor for receiving a position set point value, and an actual position value from a position sensor sensing a position of a positioning rod of said actuator and wherein said micro-processor outputs said electrical control signal input to said splitter circuit.

7. The electro-pneumatic system according to claim 6 wherein an adjustment unit for adjusting said adjustable mean control value is connected to said splitter circuit.

8. The electro-pneumatic system according to claim 7 wherein said adjustment unit comprises an actuating button or switch operable from outside of a positioner housing enclosing said positioner.

9. The electro-pneumatic system according to claim 7 wherein said adjustment unit receives an adjustment value via a communication unit.

10. The electro-pneumatic system according to claim 1 wherein said first and second main pneumatic control components each comprise a controllable pneumatic amplifier.

11. The electro-pneumatic system according to claim 10 wherein each pneumatic amplifier is connected with a respective output of a respective I/P converter as said respective first or second preliminary pneumatic control component.

12. The electro-pneumatic system according to claim 11 wherein a first of said I/P converters and a respective pneumatic amplifier connected thereto are contained in a first enclosed housing while the other of said I/P converters with its respective pneumatic amplifier is accommodated in a second enclosed housing.

13. The electro-pneumatic system according to claim 1 wherein the first and second preliminary pneumatic control components and the first and second main pneumatic control components are accommodated in a common positioner housing.

14. A method for controlling a double-acting pneumatic actuator having a first pneumatic working chamber and a second pneumatic working chamber independent of the first pneumatic working chamber, comprising the steps of:

providing a first I/P converter having an output connected to a first pneumatic amplifier having an output connected to the first pneumatic working chamber;

providing a second I/P converter having an output connected to a second pneumatic amplifier having an output connected to said second pneumatic working chamber; and generating first and second mirror-inverted electrical control signals mutually inverted around a variable mean electrical value, the first electrical control signal connecting to the first I/P converter and the second electrical control signal connecting to the second I/P converter so that mutually inverted, first and second preliminary respective pneumatic signals are output from said respective first and second I/P converters to said respective first and second pneumatic amplifiers.

15. The method according to claim 14 wherein said first and second mirror-inverted electrical control signals are created by a splitter circuit having said electrical mean control value, and said electrical mean control value being adjustable such that said first and second preliminary pneumatic signals are mutually inverted around a pneumatic mean value.

* * * * *